US006718641B2

(12) United States Patent
Hsuan

(10) Patent No.: US 6,718,641 B2
(45) Date of Patent: Apr. 13, 2004

(54) HAND OPERATED PUNCHING ASSEMBLY

(76) Inventor: Yu Hsun Hsuan, P.O. Box 10-69, Chong Ho, Taipei (TW), 235

( * ) Notice: Subject to any disclaimer, the term of this patent is extended or adjusted under 35 U.S.C. 154(b) by 131 days.

(21) Appl. No.: 09/803,473

(22) Filed: Mar. 9, 2001

(65) Prior Publication Data

US 2002/0124420 A1 Sep. 12, 2002

(51) Int. Cl.[7] ..... B26F 1/14

(52) U.S. Cl. ..... 30/363; 30/233; 30/316; 30/358

(58) Field of Search ..... 30/358, 363, 364, 30/366, 312, 119, 178, 229, 316, 233

(56) References Cited

U.S. PATENT DOCUMENTS 82,335 A * 9/1868 McIntosh ..... 30/178
698,142 A * 4/1902 Rogers ..... 30/119
756,803 A * 4/1904 Rogers ..... 144/146
2,394,385 A * 2/1946 Hueber et al. ..... 30/363
3,504,436 A * 4/1970 Ebert ..... 30/358
RE32,460 E * 7/1987 Leggett, Jr. ..... 30/233
5,647,278 A 7/1997 Wu ..... 101/368

* cited by examiner

*Primary Examiner*—Boyer D. Ashley

(57) ABSTRACT

A punching tool includes a punching device, and a plier device coupled to the punching device for actuating the punching device with less force. The punching device includes a base detachably secured to one of the jaws with such as a channel-and-flange engagement, and includes a punching member movable relative to the base and operatable by the other jaw which may force the punching member relative to the base. A spring may bias the punching member away from the sheet materials to be cut. A cover is engaged with the punching member and attached to one of the jaws for detachably securing the punching member to that jaw.

11 Claims, 6 Drawing Sheets

HAND OPERATED PUNCHING ASSEMBLY

BACKGROUND OF THE INVENTION

1. Field of the Invention

The present invention relates to a punching assembly, and more particularly to a hand operated punching assembly.

2. Description of the Prior Art

U.S. Pat. No. 5,647,278 to Wu discloses a typical punching device including a pressing block slidably engaged in an opening of an outer housing and extendible outward of the outer housing, for allowing the pressing block to be depressed inward of the outer housing to a printing unit into a through hole of a retaining base member. The users hands may feel hurt when or after depressing the pressing block several times.

The present invention has arisen to mitigate and/or obviate the afore-described disadvantages of the conventional punching devices.

SUMMARY OF THE INVENTION

The primary objective of the present invention is to provide a punching assembly including a hand operating plier device for actuating or operating the punching device and for allowing the punching device to be easily and effectively operated.

In accordance with one aspect of the invention, there is provided a punching assembly comprising a punching device, and a plier device coupled to the punching device for actuating the punching device.

The plier device includes a first jaw and a second jaw, the punching device includes a base attached to the second jaw and includes a punching member movable relative to the base, the first jaw of the plier device is provided for engaging with and for forcing the punching member relative to the base.

The base includes an orifice formed therein for slidably receiving the punching member, and includes a slot formed therein and communicating with the orifice of the base for receiving a sheet material to be cut.

The base includes a pad engaged in the slot thereof and aligned with the orifice of the base for engaging with the punching member.

A spring biasing device is further provided for biasing the punching member toward the first jaw and away from the second jaw. The punching member includes an enlarged head provided thereon, the biasing means includes a spring engaged between the head and the base.

A cover is further provided and attached to the first jaw and engaged with the punching member. The cover includes an aperture formed therein, the first jaw includes a catch extended therefrom and engaged into the aperture of the cover.

A device is further provided for securing the base to the second jaw of the plier device and includes a channel-and-flange engagement for securing the base to the second jaw of the plier device.

The base includes at least one channel formed therein, the second jaw includes at least one flange provided thereon and engaged into the channel of the base for securing the base to the second jaw of the plier device.

The base includes a pair of ribs extended therefrom for defining the channel between the ribs. The second jaw includes an opening formed therein and defined by a pair of arms for receiving the base, the flange of the second jaw is extended inward of the opening of the second jaw for engaging into the channel of the base.

The first jaw and the second jaw are rotatably secured together with a pivot shaft and each includes a handle extended therefrom for moving the first jaw and the second jaw toward and away from each other, and the plier device includes two sleeves engaged onto the handles respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
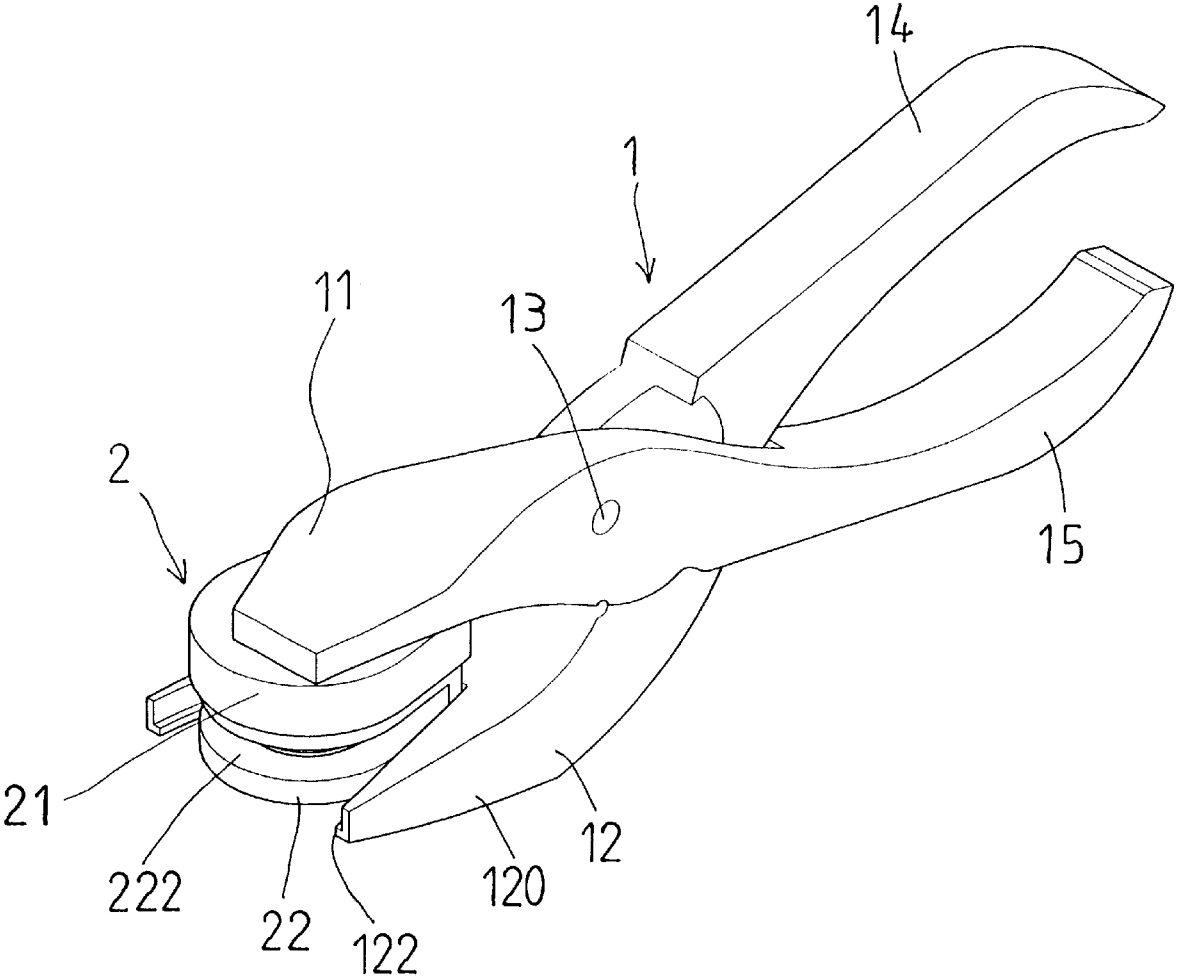
FIG. 1 is a perspective view of a punching assembly in accordance with the present invention.
Figure 2:
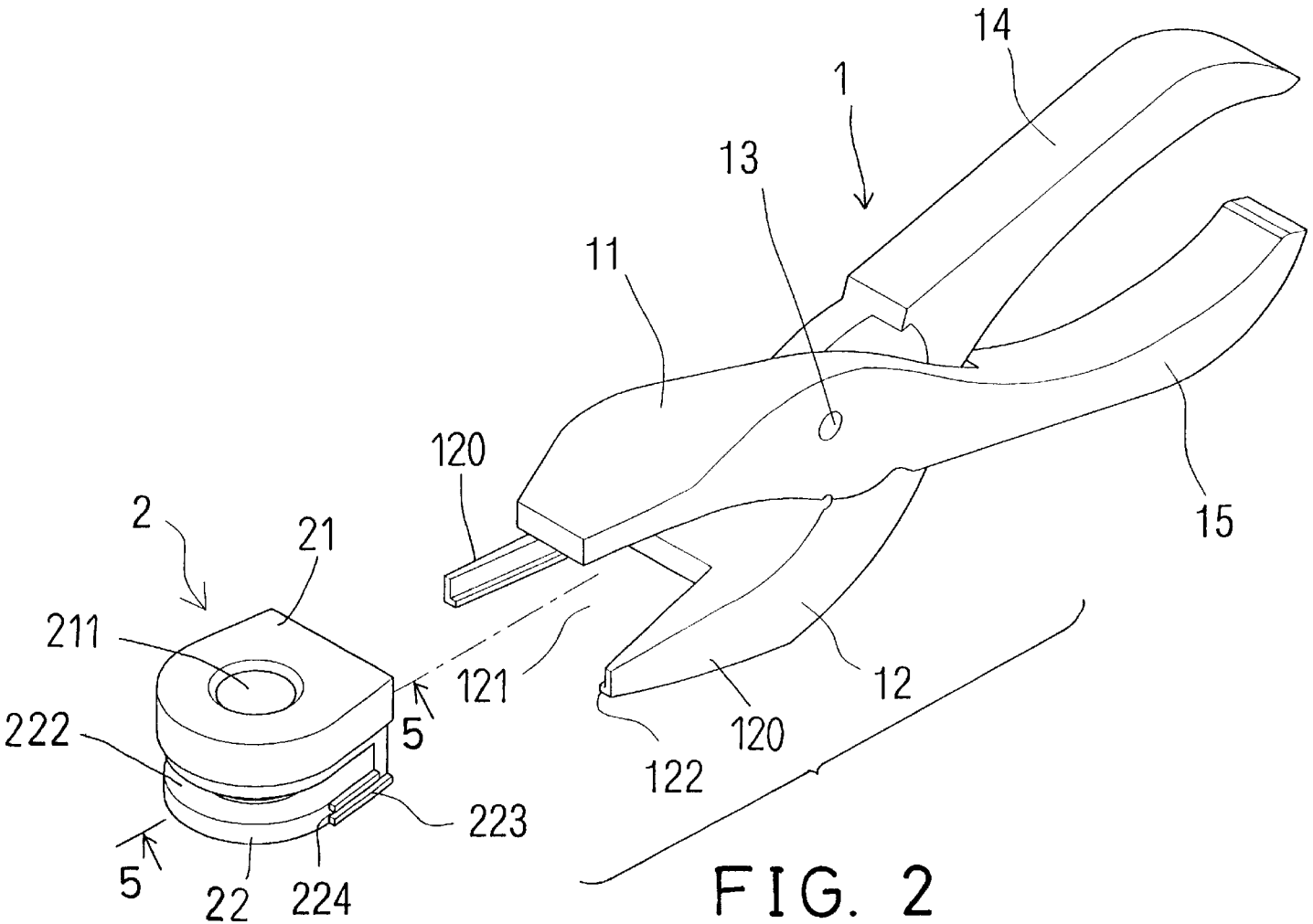
FIG. 2 is a partial exploded view of the punching assembly.
Figure 3:
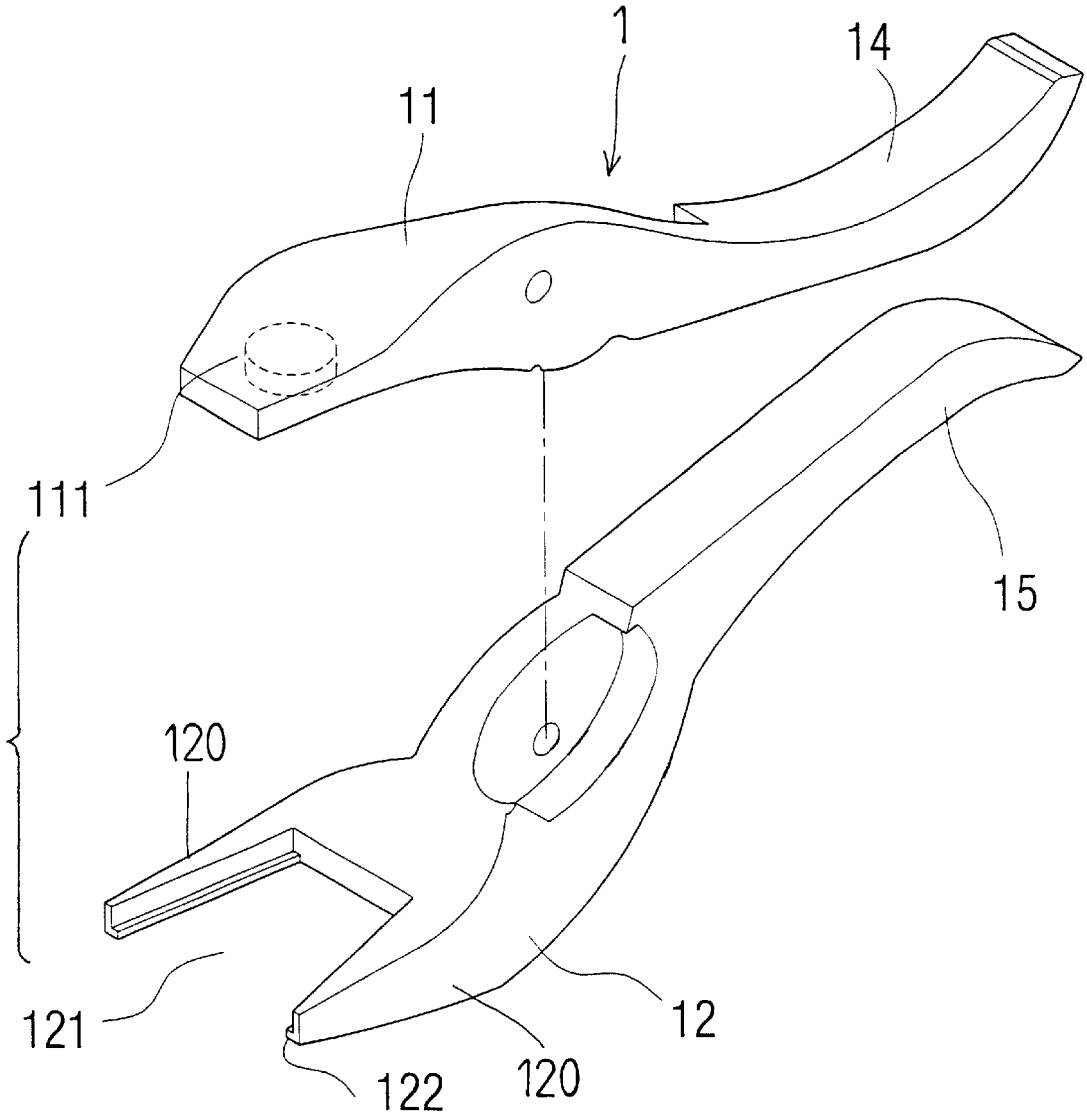
FIG. 3 is a partial exploded view showing the plier device of the punching assembly.
Figure 4:
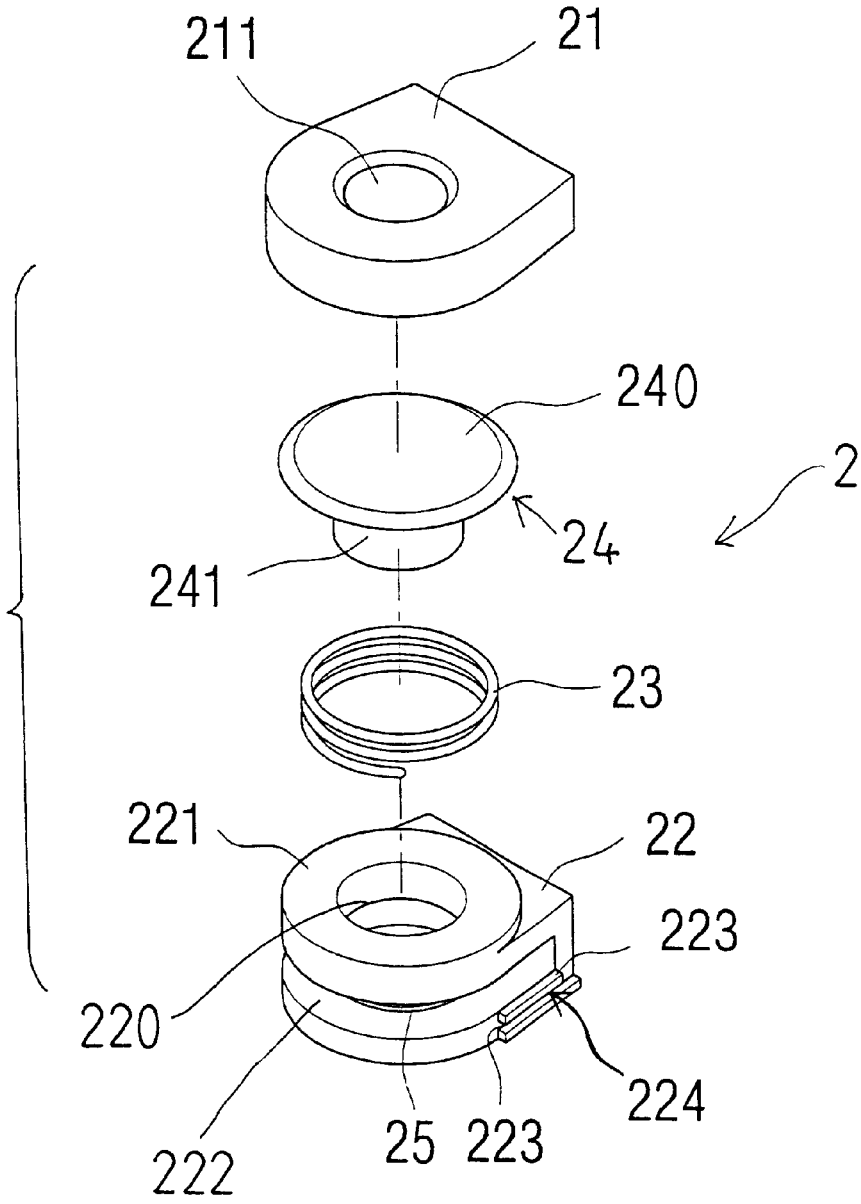
FIG. 4 is a partial exploded view showing the punching device of the punching assembly.

Referring to the drawings, and initially to FIGS. 1–5, a punching assembly in accordance with the present invention comprises a plier device 1 coupled to a punching device 2 for operating and actuating the punching device 2 with the plier device 1. The plier device 1 includes a pair of jaws 11, 12 pivotally or rotatably secured together with a pivot shaft 13 and each having a handle 15, 14 extended therefrom for actuating or moving the jaws 11, 12 toward or away from each other. The jaw 12 includes an opening 121 formed therein and defined by a pair of arms 120, for receiving the punching device 2, and includes a pair of opposite racks or flanges 122 extended inward of the opening 121 thereof. The other jaw 11 includes a projection or a catch 111 extended therefrom, particularly extended toward the jaw 12.

The punching device 2 includes a base 22 engaged in the opening 121 of the jaw 12 and having an orifice 220, such as a vertical orifice 220 formed therein and having a slot 222, such as a horizontal slot 222 formed therein and intersecting or communicating with the orifice 220 thereof for receiving the sheet materials to be cut or punched. The base 22 includes two channels 224 formed in the side portions thereof respectively and defined by pairs of ribs 223 respectively for receiving flanges 122 of the jaw 12 and for allowing the base 22 to be detachably secured to the jaw 12 with such as a force-fitted engagement.

Figure 5:
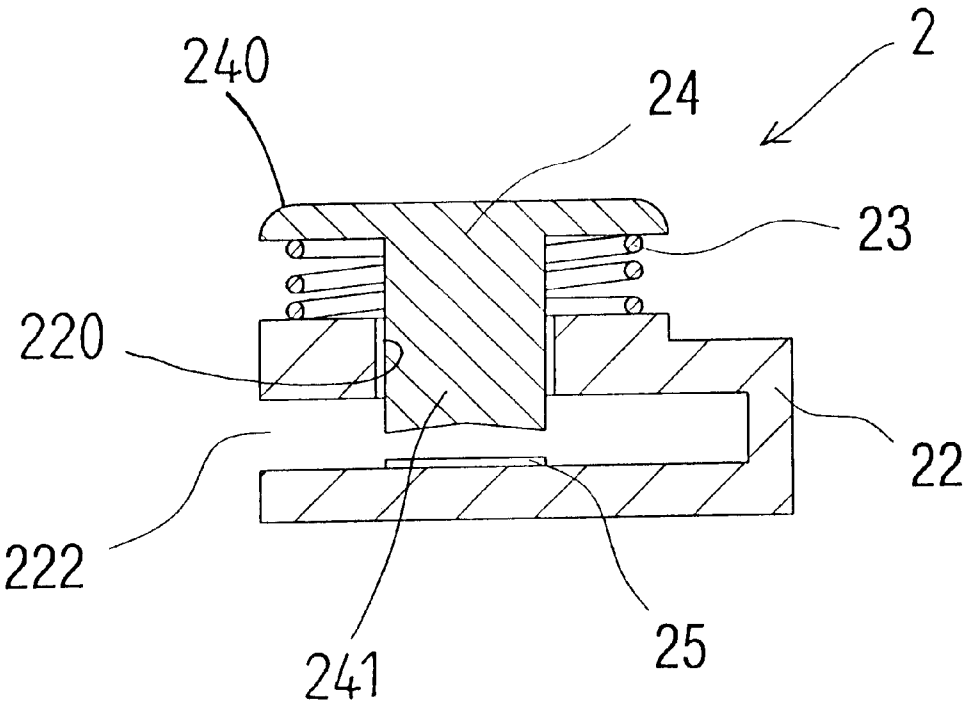
FIG. 5 is a cross sectional view taken along lines 5—5 of FIG. 2.

A punch rod 24 includes an enlarged head 240 and a punching die or a punching member 241 extended from the head 240 and slidably engaged through the orifice 220 of the base 22. A punching die or a pad 25 is disposed in the slot 222 of the base 2 and disposed below or aligned with the orifice 220 of the base 22 for receiving the punching member 241 (FIG. 5). A spring 23 is engaged on the upper portion 221 of the base 22 and the head 240 of the punch rod 24 for biasing the punching member 241 away from the pad 25 or toward the jaw 11 or away from the jaw 12. A cover 21 is engaged on the head 240 of the punch rod 24 and may be partially engaged onto the base 22, and includes an aperture 211 formed therein for receiving the catch 111 of the jaw 11 and for detachably securing to the jaw 11 with such as a force-fitted engagement. The spring 23 may also bias the cover 21 to engage with the jaw 11.

In operation, the punching member 241 of the punch rod 24 may be forced or depressed through the slot 222 of the base 20 and toward the pad 25 for cutting or punching the sheet materials engaged into the slot 222 of the base 20, by forcing the jaws 11, 12 of the plier device 1 toward each other, and by forcing the handles 14, 15 of the plier device 1 toward each other. The punch device 2 may thus be easily operated or actuated by the plier device 1 with less force and without hurting the hands of the users.

Figure 6:
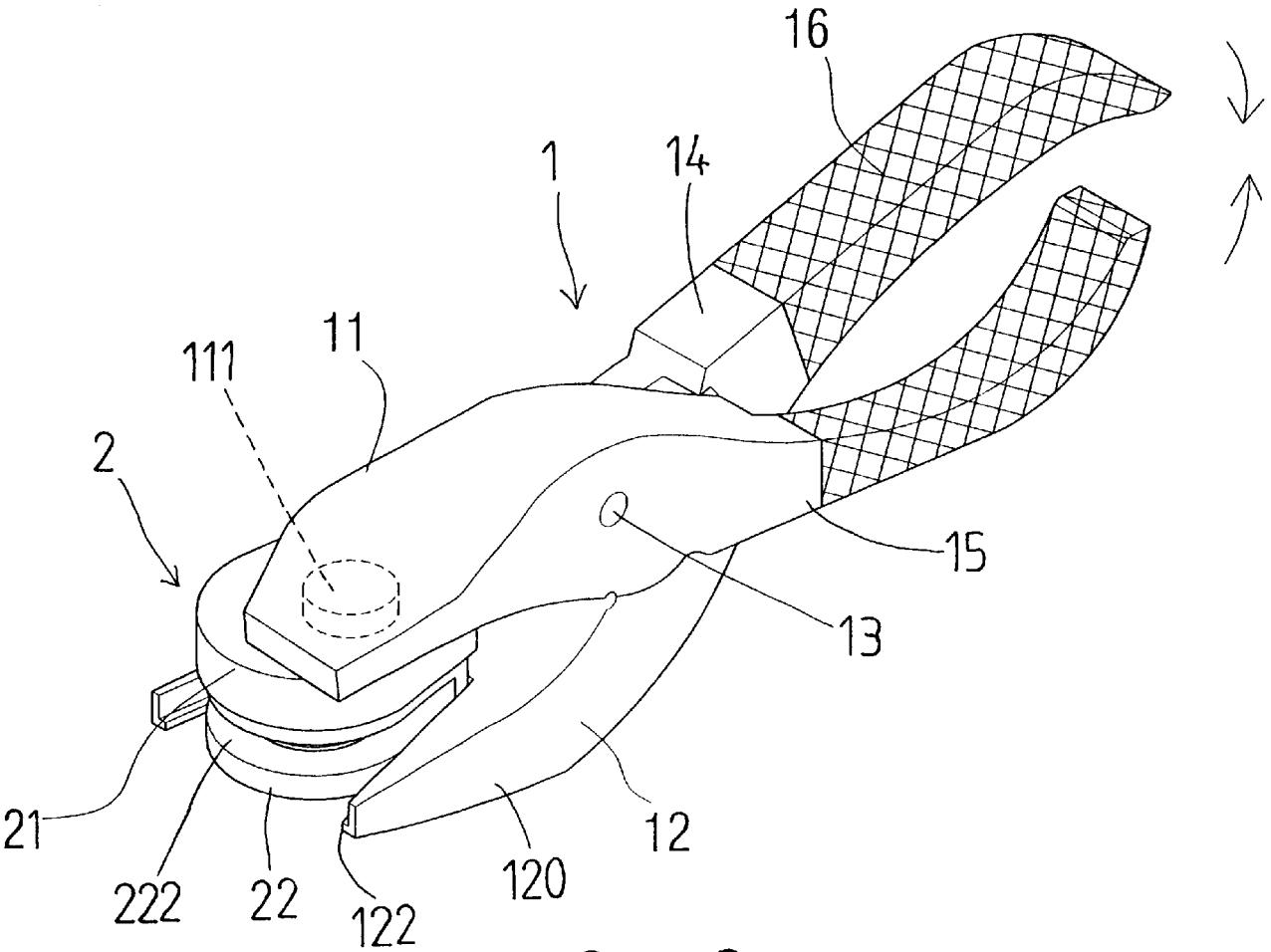
FIG. 6 is a perspective view illustrating the other embodiment of the punching assembly.

Referring next to FIG. 6, the handles 14, 15 of the plier device 1 may each include a protective sleeve 16 engaged on the outer portion thereof for facilitating the grasping or the holding of the handles 14, 15 of the plier device 1. The protective sleeves 16 may include a knurled outer peripheral surface having various kinds of colors or patterns for increasing the friction or the holding or the grasping of the handles 14, 15 of the plier device 1.

Accordingly, the punching assembly in accordance with the present invention includes a hand operating plier device for actuating or operating the punching device and for allowing the punching device to be easily and effectively operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A punching assembly comprising:

a punching device, and a pliers device coupled to said punching device for actuating said punching device, said pliers device including a first jaw and a second jaw, said punching device including a base attached to said second jaw and including a punching member movable relative to said base, said first jaw of said pliers device being provided for engaging with and for forcing said punching member relative to said base, said base including an orifice formed therein for slidably receiving said punching member, and including a slot formed therein and communicating with said orifice of said base for receiving a sheet material to be cut, said base including a pad engaged in said slot thereof and aligned with said orifice of said base for engaging with said punching member.

2. The punching assembly according to claim 1 further comprising a cover attached to said first jaw and engaged with said punching member.

3. The punching assembly according to claim 1 further comprising means for biasing said punching member toward said first jaw and away from said second jaw.

4. The punching assembly according to claim 3, wherein said punching member includes an enlarged head provided thereon, said biasing means includes a spring engaged between said head and said base.

5. A punching assembly comprising:

a punching device, a pliers device coupled to said punching device for actuating said punching device, said pliers device including a first jaw and a second jaw, said punching device including a base attached to said second jaw and including a punching member movable relative to said base, said first jaw of said pliers device being provided for engaging with and for forcing said punching member relative to said base, and a cover attached to said first jaw and engaged with said punching member, said cover including an aperture formed therein, said first jaw including a catch extended therefrom and engaged into said aperture of said cover.

6. The punching assembly according to claim 1 further comprising means for securing said base to said second jaw of said pliers device.

7. The punching assembly according to claim 6, wherein said securing means includes a channel-and-flange engagement for securing said base to said second jaw of said pliers device.

8. The punching assembly according to claim 6, wherein said base includes at least one channel formed therein, said second jaw includes at least one flange provided thereon and engaged into said at least one channel of said base for securing said base to said second jaw of said pliers device.

9. The punching assembly according to claim 8, wherein said base includes a pair of ribs extended therefrom for defining said at least one channel between said ribs.

10. A punching assembly comprising:

a punching device, a pliers device coupled to said punching device for actuating said punching device, said pliers device including a first jaw and a second jaw, said punching device including a base attached to said second jaw and including a punching member movable relative to said base, said first jaw of said pliers device being provided for engaging with and for forcing said punching member relative to said base, means for securing said base to said second jaw of said pliers device, said securing means including at least one channel formed in said base, at least one flange provided on said second jaw and engaged into said at least one channel of said base for securing said base to said second jaw of said pliers device, and said second jaw including an opening formed therein and defined by a pair of arms for receiving said base, said at least one flange of said second jaw being extended inward of said opening of said second jaw for engaging into said at least one channel of said base.

11. The punching assembly according to claim 1, wherein said first jaw and said second jaw are rotatably secured together with a pivot shaft and each includes a handle extended therefrom for moving said first jaw and said second jaw toward and away from each other, and said pliers device includes two sleeves engaged onto said handles respectively.

* * * * *